United States Patent [19]

Sekiya

[11] Patent Number: 4,565,034

[45] Date of Patent: Jan. 21, 1986

[54] GRINDING AND/OR CUTTING ENDLESS BELT

[75] Inventor: Shinji Sekiya, Tokyo, Japan

[73] Assignee: Disco Abrasive Systems, Ltd., Tokyo, Japan

[21] Appl. No.: 567,682

[22] Filed: Jan. 3, 1984

[51] Int. Cl.[4] ..... B24D 11/00

[52] U.S. Cl. ..... 51/401; 51/207

[58] Field of Search ..... 51/394, 401, 402, 406, 51/407, 207, 295, 309, DIG. 9, DIG. 6, DIG. 32, DIG. 34

[56] References Cited

U.S. PATENT DOCUMENTS

| | | | |
|---|---|---|---|
| 1,603,374 | 10/1926 | Bart | 51/DIG. 34 |
| 3,067,551 | 12/1962 | Maginnis | 51/207 X |
| 3,517,464 | 6/1970 | Mattia et al. | 51/309 |
| 4,047,902 | 9/1977 | Wiand | 51/295 |
| 4,131,436 | 12/1978 | Wiand | 51/309 |
| 4,256,467 | 3/1981 | Gorsuch | 51/295 |
| 4,288,233 | 9/1981 | Wiand | 51/DIG. 34 |

FOREIGN PATENT DOCUMENTS

| | | | |
|---|---|---|---|
| 22194 | 2/1977 | Japan | 51/207 |
| 131195 | 10/1979 | Japan | 51/207 |

*Primary Examiner*—Robert P. Olszewski

*Attorney, Agent, or Firm*—McDougall, Hersh & Scott

[57] ABSTRACT

For adaptation to grinding or cutting precise or minute parts, a grinding and/or cutting endless belt is made of grindstone comprising electrodeposited abrasive grains.

3 Claims, 6 Drawing Figures

GRINDING AND/OR CUTTING ENDLESS BELT

BACKGROUND OF THE INVENTION

1. Field of the Invention

The present invention relates to a grinding and/or cutting endless belt which is adapted to grind or cut precise or minute parts such as optical parts, magnetic heads, semiconductor devices and so on.

2. Description of the Prior Art

Conventionally, for cutting or grinding precise or minute optical parts, for example, optical fiber connector, a wheel type grindstone has been used in general. The end surface of such an optical fiber connector to be ground is pressed onto a rotating surface of the wheel type grindstone. However, in such a grinding wheel, the grinding speed varies in accordance with the distance from the axis of the grinding wheel. Namely, the larger the distance from the axis is, the higher the grinding speed is. Thus, even if the location of the optical fiber connector slightly deviates in the radial direction of the grinding wheel, it varies that the ground depth of the end surface of the optical fiber connector in a predetermined time. As a result, the ground depth of each optical fiber connector becomes unequal and so these connectors are difficult to be precisely coupled with each other.

Besides, such a wheel type grindstone has need of a drive shaft at the center thereof. For this configuration, the grindstone itself needs to be large-sized and so large driving force is required. Furthermore, in such a wheel type grindstone, since only a predetermined part thereof must be used for uniform grinding as described above, the grindstone is consumed only in part. The large driving force and partial consumption result raising the cost of the optical fiber device.

On the other hand, a grinding endless belt and a cutting endless belt (a band saw) have been known. The conventional grinding belt has a paper or cloth base on which, for example, diamond abrasive grains are supported with an adhesive agent. However, in such known grinding endless belt, the bonds of the abrasive grains are very small and further only one layer of diamond abrasive grains is provided. Thus, the life of the grinding belt of this type is very short. The grinding belt of this type is originally for rough grinding and unsuitable for precise processing because of the small bonds of the abrasive grains.

The band saw comprises a steel belt and a large number of diamond chips attached to the edge of the steel belt. Such a band saw is only for cutting and can not be used for grinding. Furthermore, in the band saw, since each diamond chip is made of metal bonded grindstone, it is difficult to form diamond chips of small thickness, specifically, below 0.3 mm. Therefore, with the band saw, the cutout width of an article to be cut is considerably large and far more than 0.3 mm. For this reason, the conventional band saw is also unsuitable for precise processing.

BRIEF SUMMARY OF THE INVENTION

Accordingly, it is an object of the present invention to provide a grinding and/or cutting endless belt which is adapted to grind or cut precise or minute parts.

It is another object of the present invention to provide a grinding and/or cutting endless belt with which the whole device for grinding or cutting is smaller in size than that with the conventional grinding wheel.

It is still another object of the present invention to provide a grinding and/or cutting endless belt with which precise or minute parts are processed at the lower cost than that with the conventional grinding wheel.

It is still another object of the present invention to provide a grinding and/or cutting endless belt which can comprise a plurality of layers of abrasive grains for elongating the life of grindstone.

It is still another object of the present invention to provide a grinding and/or cutting endless belt which can have the small thickness, for example, smaller than 0.3 mm in order to cut an article with the cutout width as small as possible.

According to the aspect of the present invention, a grinding and/or cutting endless belt is made of grindstone comprising electrodeposited abrasive grains.

Other and further objects, features and advantages of the invention will appear more fully from the following description.

DETAILED DESCRIPTION OF THE PREFERRED EMBODIMENTS

Referring first to FIGS. 1, 2, 4 and 5, the first embodiment of the present invention will be described.

Figure 2:
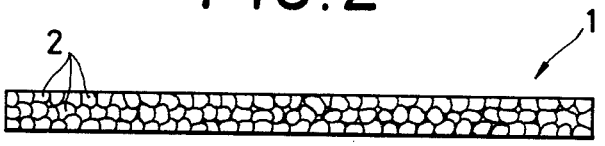
FIG. 2 is a sectional view taken along line II—II of FIG. 1.

As shown in FIG. 2, according to this embodiment, the whole body of an endless belt 1 is made of grindstone and no base material is provided. In the grindstone 1, abrasive grains 2 comprise superabrasive grains such as natural or synthetic diamond abrasive grains and cubic boron nitride abrasive grains and are strongly bonded with deposited metal, preferably nickel or copper. The grindstone 1 may be manufactured as follows.

Figure 5:
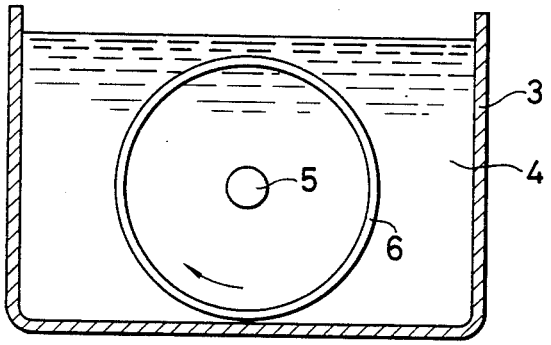
FIG. 5 is a shematic view of an electrodeposition tank.

As shown in FIG. 5, an electrodeposition tank 3 filled with an electrolytic solution 4 is provided with a nickel bar 5 as anode. An electrodeposition mold 6 made of nickel, copper, stainless steel, aluminum or the like into a cylindrical shape is arranged as cathode arround the nickel bar 5. The outer surface and the both end surfaces of the cylindrical mold 6 are covered with an insulation coating. Abrasive grains such as diamond abrasive grains and cubic boron nitride abrasive grains are dispersed in the electrolytic solution 4.

The electrodeposition is effected while the mold 6 is rotated at a predetermined velocity as shown by an arrow in FIG. 5 for uniform deposition. In this process, nickel is deposited onto the inner surface of the mold 6 with abrasive grains which have been dispersed in the electrolytic solution 4. As a result, a grindstone in which the electrodeposited abrasive grains are strongly bonded with the deposited nickel is formed on the inner surface of the mold 6 into an endless shape. Subsequently, the mold 6 on which the grindstone is formed is taken out from the electrodeposition tank 3 and the grindstone is peeled from the mold 6. Alternatively, when the electrodeposition mold 6 is made of aluminum, the mold 6 may be dissolved off from the grindstone with sodium hydroxide.

A grindstone manufactured by electrodeposition has the structure that the abrasive grains are closely packed therein and strongly bonded with deposited metal. Thus, such a grindstone is suitable for grinding or cutting precise on minute parts. Besides, in such a grindstone, abrasive grains can be deposited into a plurality of layers. Thus, the life of this grindstone is longer than that of the conventional grinding belt.

Figure 1:
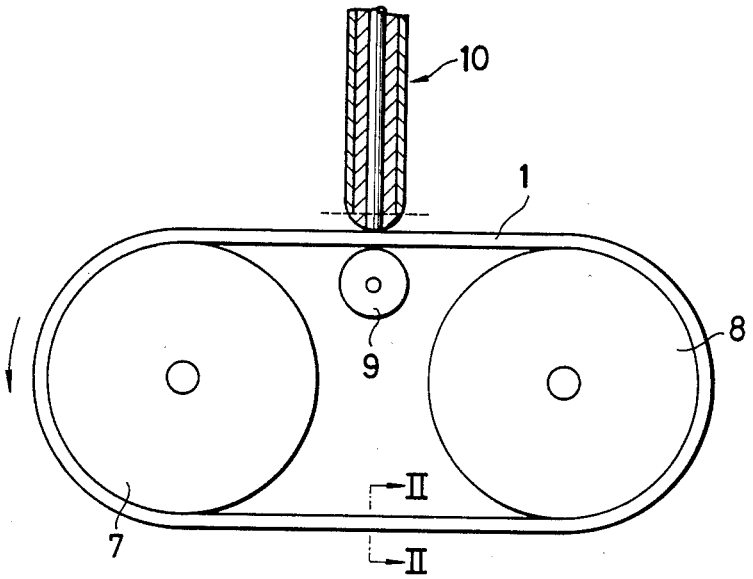
FIG. 1 is a schematic front view of a grinding and/or cutting device according to the first embodiment of the present invention.

As shown in FIG. 1, an endless belt 1 made of grindstone comprising electrodeposited abtrasive grains is extended between a pair of belt pulleys 7 and 8. A press roller 9 is disposed between the pulleys 7 and 8 inside the endless belt 1. The endless belt 1 is run, for example, at about 10 m/min shown by an arrow in FIG. 1 by being driven by one of the pulleys 7 and 8. A precise or minute part, for example, an optical fiber connector 10 the lower end of which is to be ground is pressed onto the outer surface of the endless belt 1 at the opposite position with the press roller 9.

In this configuration, the grinding speed is uniform at any position of the endless belt 1. Therefore, even if the location of the optical fiber connector 10 deviates, the connector 10 can be uniformly ground. Besides, since the whole of the outer surface of the endless belt 1 can be used for grinding, the partial consumption as the conventional grinding wheel can be avoided. Such avoidance of the partial consumption serves the elongation of the life of the grindstone. Further, since the driving mechanism may be arranged separately from the grinding device, the design of the device is not limited unlike the conventional grinding wheel and so the whole size of the grinding device and the driving force thereof can be smaller. The avoidance of the partial consumption and the smaller driving force result lowering the cost of processed parts.

Figure 4:
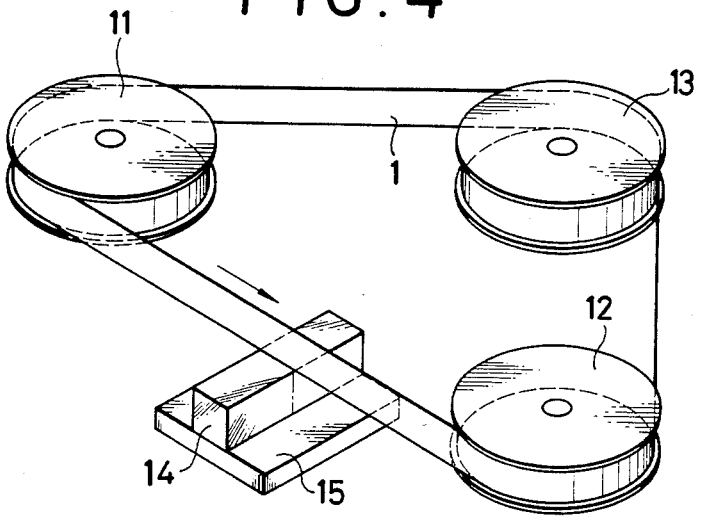
FIG. 4 is a shematic perspective view of a cutting device according to the first embodiment.

FIG. 4 shows a cutting operation of the endless belt 1 which has the length of 1 m, the width of 10 mm and the thickness of 0.1 mm. In the endless belt 1, diamond abrasive grains of the U.S. mesh No. (#) 320 were used and nickel was used as deposited metal. The endless belt 1 was extended so as to run through three belt pulleys 11, 12 and 13 at 500 to 1000 m/min. An article to be cut, for example, a glass block having a square section of 20 mm×20 mm was mounted on a mount table 15 and cut with the edge of the endless belt 1. The mount table 15 could be ascended at the speed of 10 mm/min and therefore the cutting speed was 10 mm/min.

According to this embodiment, the endless belt 1 is made of grindstone comprising electrodeposited abrasive grains. Thus, the thickness of the endless belt 1 can be considerably small, for example, 0.1 mm as the above instance because of the strong bonds of the abrasive grains. The thickness of the endless belt is preferably smaller than 0.3 mm for precise cutting operation.

Figure 3:
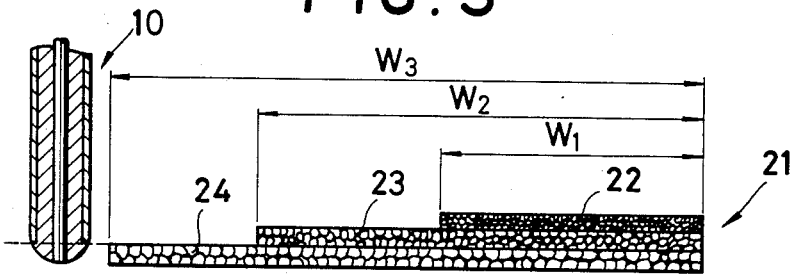
FIG. 3 is a vertical sectional view of an endless belt according to the second embodiment of the present invention.

FIG. 3 shows the second embodiment of the present invention. In this embodiment, an endless belt 21 is made of three layers of grindstone. The uppermost layer 22 of the grindstone has the smallest grain size, for example, the U.S. mesh No. (#) 2000 to 8000 and the lowermost layer 24 has the largest grain size, for example, #600 to 1500. The intermediate layer 23 has the grain size of, for example, #1000 to 4000. The thickness of each layer may be about 30μ or more. The widths $W_1$, $W_2$ and $W_3$ of the respective layers 22, 23 and 24 are laminated stepwise so that a part of the lower layer is exposed out of one side end of the upper layer as shown in FIG. 3. Alternatively, the lower layer may be partially exposed out of the both side ends of the upper layer.

The endless belt 21 may be manufactured as following process.

At the first, by the manner described in relation to FIG. 5, the lowermost layer 24 is formed on the electrodeposition mold 6. The grain size of the abrasive grains dispersed in the electrolytic solution 4 is within the range of #600 to 1500. After the first electrodeposition, the mold 6 and the lowermost layer 24 of the grindstone formed on the mold 6 are taken out from the electrolytic solution 4. Then the inslation coating is additionally applied to the part or parts of the inner surface of the lowermost layer 24 to be exposed.

Next, the second electrodeposition is effected with use of the electrolytic solution in which abrasive grains having the grain size within the range of #1000 to 4000 are dispersed. By this second electrodeposition, the intermediate layer 23 is formed on the part of the inner surface of the lowermost layer 24 to which the inslation coating has not been applied. Then the mold 6 with two layers of the grindstone is again taken out from the electrolytic solution so that the inslation coating is additionally applied to the part or parts of the inner surface of the intermediate layer 23 to be exposed.

Subsequently, the third electrodeposition is effected with use of the electrolytic solution in which abrasive grains having the grain size within the range of #2000 to 8000. By this third electrodeposition, the uppermost layer 22 is formed on the intermediate layer 23.

By repeating the above steps, any number of layers of grindstone can be manufacutured. The mold 6 is removed from the grindstone after the last electrodeposition.

The endless belt 21 according to this embodiment may be used as follows. At the first, an optical fiber connector 10 the lower end of which is to be ground is arranged at the side of the endless belt 21 as shown in FIG. 3. The endless belt 21 is extended between pulleys similarly to FIG. 1 so as to run in the direction perpendicular to the sectional plane of FIG. 3. The optical fiber connector 10 is then moved to the right in FIG. 3 so that the lower end portion thereof is cut at the broken line with edge of the lowermost layer 24 of the grindstone. For this cutting operation, the running of the endless belt 21 is regulated to a higher speed. In contrast to this, the grinding operation is effected at a low speed of the endless belt 21. After the cutting operation, the optical fiber connector 10 is successively moved to the right so that the cut surface of the lower end portion is roughly ground by the exposed surface of the lowermost layer 24 which has the largest grain size. The optical fiber connector 10 is further successively moved to the right so that the cut surface of the lower end is ground by the exposed surface of the intermediate layer 23 having the middle grain size and then by the uppermost layer 22 having the smallest grain size.

As described above, with the endless belt 21 of this embodiment, the processes of cutting and rough grinding to finish grinding can be effected at a single step only by successively moving the optical fiber connector 10.

Figure 6:
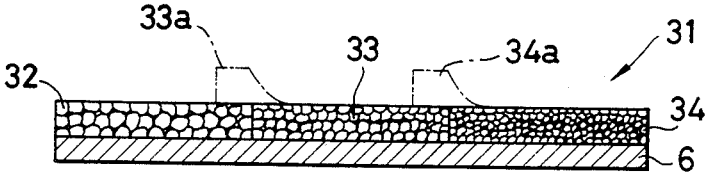
FIG. 6 is a vertical sectional view of an endless belt and an electrodeposition mold according to the third embodiment of the present invention.

FIG. 6 shows the third embodiment of the present invention. In this embodiment, an endless belt 31 is made of three parts 32, 33 and 34 of grindstone which are arranged in the width direction of the endless belt 31 and strongly bonded to each other. The parts 32, 33 and 34 of the grindstone have the largest, middle and smallest grain size, respectively.

The endless belt 31 may be manufactured as following process. Before the first electrodeposition, the outer surface, both side surfaces and a part of inner surface of the electrodeposition mold 6 are covered with an insulation coating. Then the first electrodeposition is effected with an electrolytic solution in which abrasive grains having the largest grain size are dispersed. By this first electrodeposition, the first part 32 of the grindstone is formed on the part of the inner surface of the mold 6 to which the insulation coating has not been applied. Then the mold 6 with the first part 32 of the grindstone is taken out from the electrolytic solution so that a part of the insulation coating is removed from the predetermined part of the inner surface of the mold 6 on which the second part 33 of the grindstone is to be formed and a part of the inner surface of the first part 32 of the grindstone is additionally covered with the insulation coating.

Subsequently, the second electrodeposition is effected with an electrolytic solution in which abrasive grains having the middle grain size are dispersed. By the second electrodeposition, the second part 33 of the grindstone is formed on the part of the inner surface of the mold 6 to which the insulation coating has not been applied. At this time, an overlap portion 33*a* of the second part 33 indicated by imaginary line in FIG. 6 is formed on the part of the first part 32 to which the insulation coating has not been applied. In this manner, by forming the second part 33 of the grindstone in order to overlap on the first part 32, the second part 33 strongly bonds to the first part 32.

The third part 34 of the grindstone is formed by the similar manner to the second part 33. The third electrodeposition is effected with an electrolytic solution in which abraisve grains having the smallest grain size are dispersed. An overlap portion 34*a* of the third part 34 of the grindstone is also formed on the part of the second part 33 to which the insulation coating has not been applied.

The mold 6 is removed from the grindstone after the last electrodeposition and the overlap portions 33*a* and 34*a* are ground off.

Although, in the above-described embodiments, an endless belt is used for ginding an optical fiber connector, an endless belt according to the present invention can be used for grinding or cutting glasses, ceramics, silicon wafers or the like. Particularly, an endless belt according to the present invention is suitable for grinding or cutting precise or minute parts such as precise or minute optical parts, ferrite heads, semiconductor devices and so on.

As many apparently widely different embodiments of this invention may be made without departing from the spirit and scope thereof, it is to be understood that the invention is not limited to the specific embodiments thereof except as defined in the appended claims.

What is claimed is:

1. An endless belt made of grindstone comprising a plurality of layers of electrodeposited abrasive grains and being provided with no base material for supporting said layers, the grindstone consists of a plurality of parts, each of which comprises a plurality of layers of electrodeposited abrasive grains and the grain sizes of which are different from one another, wherein said parts of said grindstone are laminated stepwise with one another so that the width of the upper part is smaller than that of the lower part and the lower part is partially exposed out of at least one side end portion of the upper part.

2. An endless belt according to claim 1, wherein the grain size of the upper part is smaller than that of the lower part.

3. An endless belt according to claim 2, wherein said grindstone consists of three parts, the lowermost part having the grain size of #600 to 1500, the intermediate part having the grain size of #1000 to 4000 and the uppermost part having the grain size of #2000 to 8000.

* * * * *